United States Patent [19]

Ginter et al.

[11] Patent Number: 4,770,214

[45] Date of Patent: Sep. 13, 1988

[54] PROCESS FOR COMPACTING AND/OR FILLING UP PULVERULENT MATERIAL

[75] Inventors: Herbert Ginter, Hanau; Gerhard Düsing, Eppstein; Wolfgang Eckert, Rheinfelden; Reinhard Manner, Dörnigheim, all of Fed. Rep. of Germany

[73] Assignee: Degussa Aktiengesellschaft, Frankfurt am Main, Fed. Rep. of Germany

[21] Appl. No.: 97,263

[22] Filed: Sep. 17, 1987

Related U.S. Application Data

[63] Continuation of Ser. No. 902,031, Aug. 25, 1986, abandoned, which is a continuation of Ser. No. 688,193, Jan. 2, 1985, abandoned.

[30] Foreign Application Priority Data

Jan. 7, 1984 [DE] Fed. Rep. of Germany ..... 3400415

[51] Int. Cl.[4] ..... B65B 31/06

[52] U.S. Cl. ..... 141/5; 55/97; 141/171

[58] Field of Search ..... 55/97, DIG. 45; 100/35, 100/90, 215, 295, 297; 141/5, 7, 10, 12, 65, 67, 73, 74, 75, 286, 256, 257, 263; 406/171

[56] References Cited

U.S. PATENT DOCUMENTS 367,857 8/1887 Smith ..... 141/257

494,979 4/1893 Dawson ..... 141/286 X

OTHER PUBLICATIONS

D. I. Marshall, "Handling Comminuted Materials", Western Electric Tech. Digest #31, Jul. 1973.

*Primary Examiner*—Mark J. Thronson

*Attorney, Agent, or Firm*—Cushman, Darby & Cushman

[57] ABSTRACT

A method for compacting and/or filling of pulverulent materials into rigid or flexible containers in the course of which the pulverulent material is filled into the container with the help of a pipe in relative motion to the container, and separated from the gas, for example air, transported along with the help of a separation device which surrounds the pipe and is fitted to the container cross section. The pulverulent material is retained in the container with the help of the separation device, while the gas escapes through the gas permeable separation device.

7 Claims, 3 Drawing Sheets

PROCESS FOR COMPACTING AND/OR FILLING UP PULVERULENT MATERIAL

This is a continuation of Ser. No. 902,031, filed Aug. 25, 1986, now abandoned, which, in turn, was a continuation of Ser. No. 688,193, filed Jan. 2, 1985, now abandoned.

BACKGROUND OF THE INVENTION

The invention relates to a method for compacting and/or filling of pulverulent materials in inflexible or flexible containers.

Pulverulent materials are filled into flexible or inflexible containers as, for example drums or sacks. Many pulverulent materials, especially pyrogenically produced oxides or mixed oxides of metals and/or metalloids, as, for example, pyrogenically produced silica, have a low bulk density and/or are strongly permeated with air. These properties necessitate large containers for filling and transport, inevitably giving rise to high packing and transportation costs.

Filling equipment for allowing the pulverulent materials to be de-aerated (compacted) simultaneously with the filling is known in the arts. Because of the increased bulk density of the aerated pulverulent materials, smaller containers are required or larger amounts of pulverulent material can be placed in the containers already at hand. The storage space is economized and the transportation costs are reduced.

Examples of the types of filling equipment which are known in the part art are:

The Carter-Vac-Filler-Equipment for filling of pulverulent products into flexible containers, permeable to gas, as, for the example valve sacks, with the help of a completely closed filling chamber; (CARTER-FILLER).

The Gerivac-Continuous-Compressor for compressing pulverulent products before filling them into small packages, pouches, open sacks, or drums (compare Chemische Rundschau 25 (1971), No. 21, page 647).

The known filling method by means of the Carter-Filler has the following disadvantages:

(a) After the filling procedure, high density variations exist within the pulverulent material in the container (density fluctuations around ±20%, in reference to the average density $\theta$ between the pulverulent material in the middle of the container and the pulverulent material at the container wall.

(b) Too high an increase in the container content necessitates too high an increase of the average density of the pulverulent materials, as, for example with pyrogenically produced silica, and results in an over-proportional lengthening of the filling time and partially in undesired changes of the industrial use properties of the pulverulent material. Thus, the increase of the average density of pyrogenically produced silica from 60 to 75 g/l (25%), requires a lengthening of the filling time of about 125%.

(c) A higher packing cost proportion is caused by the high container requirements, as, for example valve sacks with high tensile requirements.

(d) The commitment to a narrowly defined sack material, permeable to gas, prohibits, for example the use of a sack or bag material, essentially or completely impermeable to gas, which can prevent the entry of, for example moisture to the pulverulent material.

The known filling method according to the Continuous Compressor has the disadvantage that the pulverulent material is aerated again after the compression on the way to the container. If a specific density is to be achieved in the container, this can only be achieved by over-compaction of the pulverulent material in the compression device. Herein the danger exists that the industrial use properties of the pulverulent material, as, for example the dispersibility, could be changed undesirably.

The problem of the invention consists of obtaining a homogenous material density in the entire container volume as well as an increase of the average material density in the container without an undesired change in the industrial use properties, for example dispersability and thickening efficiency in filling of pulverulent materials, especially pyrogenically produced oxides or oxide mixtures of metals and/or metalloids, for example of pyrogenically produced silica.

SUMMARY OF THE INVENTION

The subject of the invention is a method for compacting and/or filling of pulverulent materials in inflexible or flexible containers, comprising filling the pulverulent material into the container with the help of at least one pipe, which can carry out a filling motion inside the container relative to the container, and separating the pulverulent material from the fluidization medium present in such a case and retaining it in the container with the help of a separation device, compactly surrounding the pipe at its open end, which has a surface suitable for separation of gas/solids and is essentially fitted dust-tight to the container cross section, out of which the present fluidization medium is allowed to escape through the gas permeable surface of the separation device with the help of a suitable pressure drop and the filling height, and with that the degree of compression of the pulverulent material in the container is determined according to the specific position of the separation device.

In a specific embodiment of the invention the pulverulent material for the filling can be withdrawn from a storage container with the help of a fluidization medium, especially fluidization air, and optionally in addition by conveyed via a transport device into a pipeline to the filling device.

Before filling the pulverulent material into the container, the pipe with the separation device can be led first to the bottom or close to the bottom of the container and finally moved in the form of a filling motion toward the container opening. The filling motion can be activated by the pressure of the pulverulent material or the gas/solid mixture in the container, in the course of which in a given case a counterforce, which is smaller or equal to the pressure of the pulverulent material or gas/solid mixture in the container, acts on the pipe and with that also on the separation device. The filling motion can also be operated mechanically, pneumatically, or hydraulically. In addition, the pipe in the direction of its longitudinal axis can be allowed to carry out an oscillating motion with the separation device, which superposes on the actual filling motion. The oscillating motion can be carried out periodically or nonperiodically with a different stroke. The amount of pulverulent material can, therefore, be volumetrically proportioned according to the variating volume of the remaining space between the container bottom, container walls, and separation device or gravimetrically proportioned with the help of scales.

Any desired industrially usable, gaseous material, as, for example air, nitrogen, or carbon dioxide can be used as fluidization medium. Air is preferably used as fluidization medium. A device suitable for gas/solid transport, as, for example a diaphragm pump, a gear pump, or an eccentric worm pump, can be used as a transport device.

Another transport device for transport of gas/solid mixture is a pressure container. This pressure container is acted on with a suitable working overpressure. During the emptying process the bottom of the pressure container can be acted on with fluidization air.

The filling of the pulverulent material likewise can take place with several, for example two or three, pipes simultaneously. It is important that these pipes at their open end in a given case are precisely connected to the same separation device.

The pressure drop on the surface of the separation device suitable for separation of gas/solids can be produced via superatmospheric pressure in the fluidization medium and/or by a vacuum at the container opening or separation device.

Preferably, overpressure is produced in the fluidization medium via the transport device, for example with the help of a diaphragm pump or a superatmospheric pressure container.

The pressure drop can be periodically constant or intermittent.

The surface suitable for separation of gas/solids can, for example consist of sintered metal or porous ceramic. In a different embodiment of the invention, the surface of the separation device can consist of a cloth, permeable to gas, or felt made of wire or natural or synthetic organic or inorganic fibers, arranged on stable, gas permeable, carriers. A perforated plate can, for example be used as a stable carrier.

The surface suitable for the separation of gas/solids can be planar or arcuate. In the case where the surface is arcuate, the pipe or pipes can be arranged with their open ends on the concave or convex side of the hollow body formed by the arch-shaped surface.

The surface suitable for separation of the gas/solids must furthermore be dust-tightly fitted to the container wall. For the compression there can be used, for example brushes or a ring with a suitable, for example round, cross section of elastic hollow or solid material. It is essential that the surface suitable for gas/solid separation can slide tightly into the container. The inner room, of the rigid or flexible container should in the course of its longitudinal axis, show a constant, congruent cross section surface at right angle to the container longitudinal axis, which is identical to the axis of the filling motion. A sufficient tightness between the container wall and the separation device thereby exists throughout the entire filling height.

The completion of the filling can be carried out in such manner that the gas/solid mixture transport and the relative motion from container to the pipe with the separation device are terminated simultaneously, or the relative motion with the separation device from container to pipe is ended before the completion of the gas/solid mixture transport. During the filling process the container, preferably with flexible containers as, for example sacks, can be surrounded by a support construction, which can absorb the mechanical stress, occurring in the filling.

The method according to the invention has the advantage that a higher average and more constant density of the pulverulent material in the container is maintained in the course of which the good industrial use properties are retained. It makes possible greater flexiblility in the adjustment of the pulverulent material's average density in the container. Simpler and, therefore, cheaper containers can be used. A special advantage is that substantially gas and moisture tight containers can be used. This means greater freedom in choosing the container materials.

The method according to the invention is suitable for filling of carbon black, color pigments and/or silicas, as, for example precipitated or pyrogenically produced silicas. Preferably, the method according to the invention is suitable for filling of pyrogenically produced oxides or mixed oxides of metals and/or metalloids, e.g., titanium dioxide, zirconium dioxide or especially pyrogenically produced silica.

The method according to the invention is explained in more detail with the help of the drawings.

DETAILED DESCRIPTION

Figure 1:
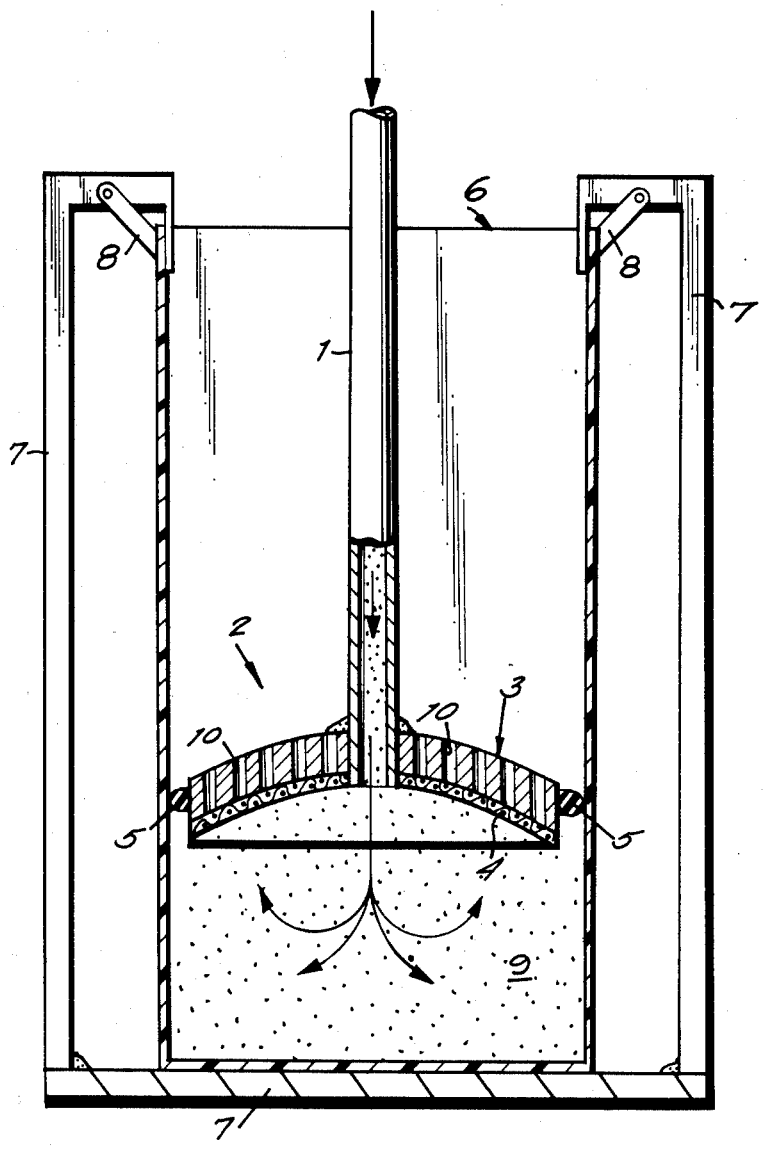
FIG. 1 shows the filling with the help of an arcuate-shaped surface of the separation device, which a pipe is arranged on the convex side such that its opening is snugly sealed to the concave side of the surface.

According to FIG. 1 the pipe (1) is arranged on the convex side of the separation device (2), by which the opening of the pipe is tightly sealed to the concave side of the surface. This consists of the perforation plate (3) on which there is arranged the separation surface (4) for the separation of gas/solid mixture.

The separation device (2) is surrounded by the ring (5) of elastic material whereby a substantially dust-tight sealing exists between the separation device (2) and the flexible wall of the container (6). The flexible wall of the container (6) is attached in the frame (7) with the help of clamps (8).

The pulverulent material mixed with air is transported through the pipe (1) into the space (9) between the separation device (2) and the flexible wall of the container (6). The pulverulent material is retained in this space (9) by the separation device (2) while the air escapes through the openings (10) of the separation device (2).

Figure 2:
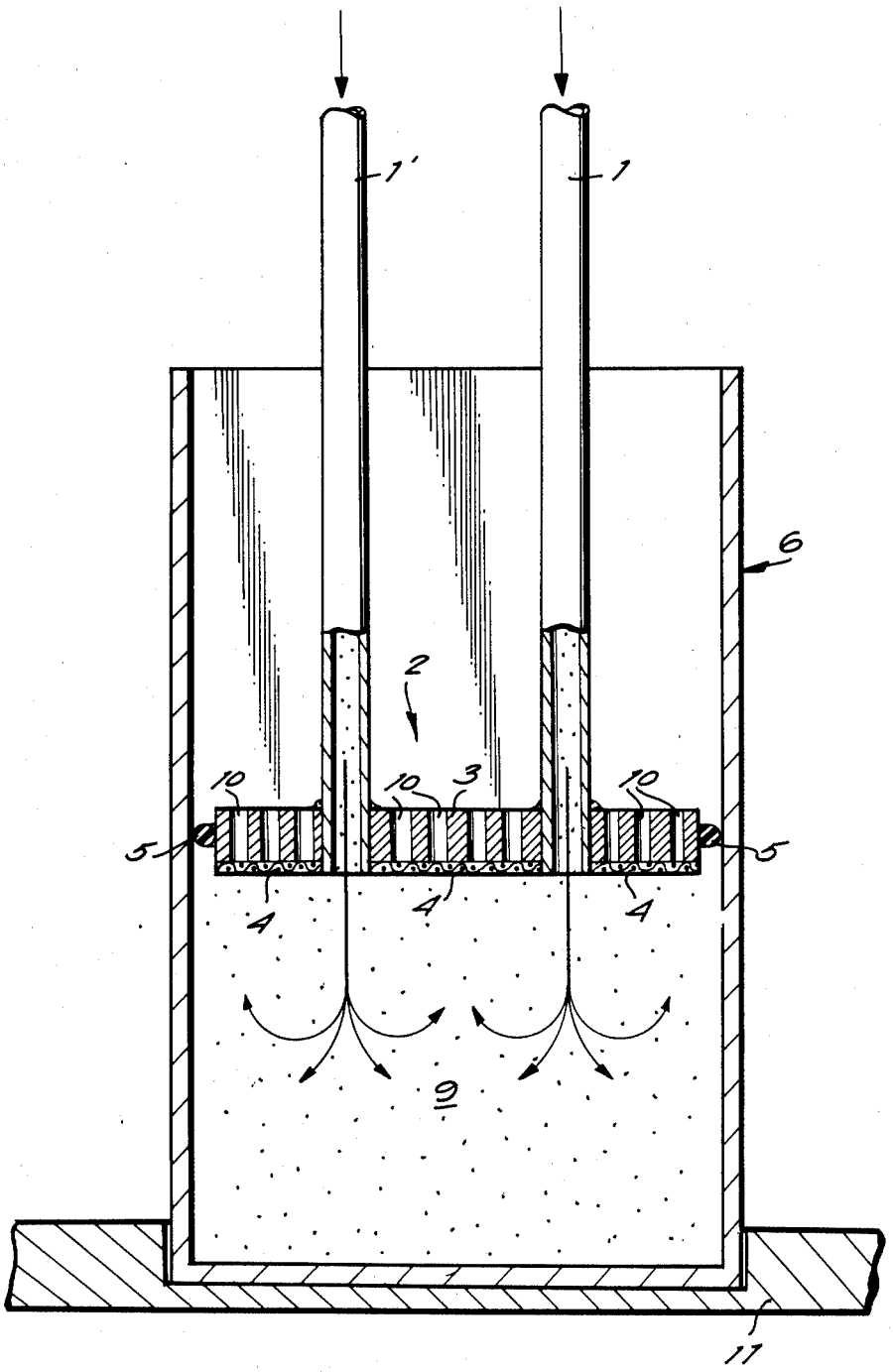
FIG. 2 shows the filling with the help of a plane shaped surface of the separation device on which two pipes are arranged such that their openings are snugly sealed to the side opposite the pipes.

According to FIG. 2 the separation device (2) is constructed as a plane. Besides the pipe (1), pipe (1') is flushly arranged on the separation device (2). The container wall (6) is made of an inflexible material, so a support construction is unnecessary. To increase the stability, the container (6) is placed on the platform (11).

Figure 3:
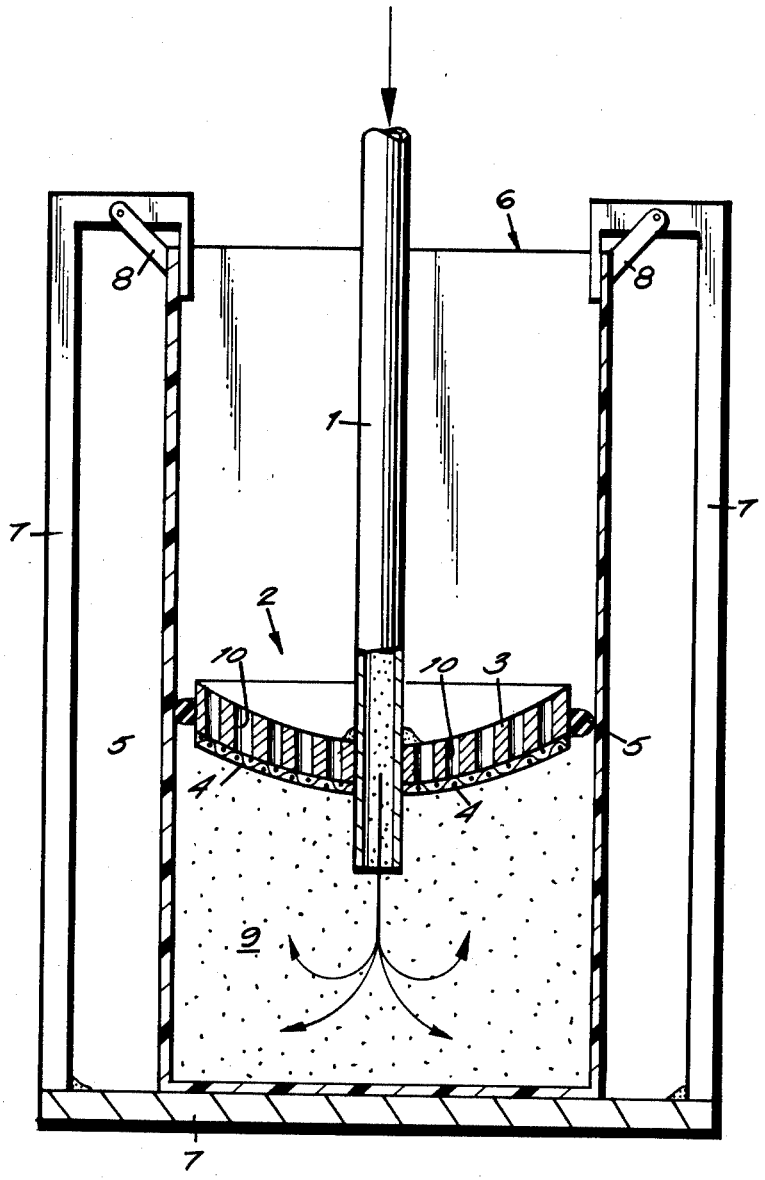
FIG. 3 shows the filling with the help of an arcuate shaped surface of the separation device where on the concave side a pipe is arranged through and beyond the concave side of the surface.

According to FIG. 3, the separation device (2) is constructed arcuately whereby the pipe (1) goes beyond the separation device (2) and protrudes into space (9). Pipe (1) is thereby arranged on the concave side of the separation device (2). For the rest, this device is used in accordance with FIG. 1.

The method according to the invention can be carried out as follows:

The pipe (1), to which the separation device (2) is attached, is led into the container to the container bottom. Then the gas/solid mixture, a pyrogenically produced silica fluidized with air, which is transported with the help of a pressure container and fluidization air, flows via the pipe into the closed space (9) formed between container bottom, container walls, and separation device. Thereby the pulverulent material remains in this space (9) while the fluidization air escapes out of the container (6) via the gas permeable surface of the separation device (2).

Pipe (1) moves with the separation device (2) in a controlled relative motion, caused by the pressure conditions on the separation device (2), out of the container (6) that is to be filled simultaneously with the entry flow of gas/solid mixture into the space (9) between the container bottom, container walls, and separation device (2) or after a suitable periodical delay.

The process can comprise, consist essentially of, or consist of the stated steps with the recited materials.

EXAMPLE 1

A block bottom bag measuring 550×220×1300 mm is attached to the clamps (8) and subsequently through rapid movement of the frame (7) with the clamps (8) grazed over the separation device (2) until the separation device (2), having a needle felt as surface, reaches or almost reaches the bottom of the bag. Now the fluidized, pyrogenically produced silica, having a surface area of about 200 $m^2/g$ and a bulk density according to DIN 53 194 (German Industrial Standard 53194) of 35 g/l, is pumped into the space (9) with the help of a diaphragm pump via pipe (1), whereby the filling overpressure amounts to about 0.5 bar. After reaching the inflation pressure the frame (7) with the bag (6) is lowered with a lowering speed of about 0.6 m/min until the separation device reaches the filled position. After a time delay of 0–5 seconds, the gas/solid mixture transport is ended by switching off the pump and the separation device is removed from the block bottom bag via a further lowering of the frame (7).

The block bottom bag is filled with 10 kg of pyrogenically produced silica to a height of about 1100 mm. The average density of this product amounts to 75 g/l with a density fluctuation of +5/−10 g/l.

The industrial use properties of the filled up, pyrogenically produced silica have not changed disadvantageously.

EXAMPLE 2

A container (6) consisting of 12 rings, each having an inner diameter of 80 mm and a height of 20 mm, the bracing elements and a bottom of synthetic resin film on a support plate is attached to a frame (7) and subsequently driven upwards with a lifting device. With the upward lifting, the stationary pipe (1) with the separation device (2) slides relatively downwardly into the container to be filled in the direction of the container bottom until the distance between separation device (2) and container bottom is about 10 mm.

The separation device (2), at the lower end of the pipe (1), consists of a perforated plate onto which a filter cloth LAINYL M9/S5/HCa is attached as separation surface (4). The separation device is sealed to the container (6) with the help of an O-ring (5).

Now the fluidized, pyrogenically produced silica, having a surface area of about 200 $m^2/g$ and a bulk density according to DIN 53 194 of about 35 g/l, is pumped into space (9) via the pipe (1) with the help of a diaphragm pump, whereby the inflation overpressure amounts to about 0.5 bar. After reaching the filling pressure the container (6) is lowered with a lowering speed of about 0.6 m/min until the separation device reaches the filled position. After a delay of 0–5 seconds, the gas/solid mixture transport is ended by switching off the pump and the separation device is directed out of the container (6) by a further lowering of the frame (7).

The container is filled with pyrogenically produced silica to a height of about 250 mm. The silica has an average density of about 67 g/l with a fluctuation of the average density in the individual ring elements of the container of +3/−5 g/l.

The industrial use properties of the filled up pyrogenically produced silica have not changed disadvantageously.

The filter cloth is characterized as follows:

LAINYL M9/S5/4Ca
Monofil Rilsan 11-cloth
Weight about 355 $g/m^2$
air permeability according to DIN 53 887 about 500 l
calendered.

The entire disclosure of German priority application No. P3400415.7 is hereby incorporated by reference.

What is claimed is:

1. A method of filling and compacting pulverulent pyrogenically produced silicon dioxide material containing a fluidizing gas into a container comprising the steps of disposing the material containing fluidizing gas at a superatmospheric pressure into said container through a pipe with said pipe being movable relative to the interior of said container, said pipe at one end having an open end, said pipe being movable along an axis from adjacent one end of said container to adjacent the opposite end thereof, separating at least some of the fluidizing gas from the pulverulent material by means of a separation device, said separation device surrounding and being mounted flushly at said open end of said pipe, said separation device including a surface which is permeable to the fluidizing gas to effect gas/solid separation, said separation device having a peripheral edge disposed at a selected radial distance from the axis of said pipe, said edge being fixed to said separation device and moving with said pipe, and said container having an interior surface having a diameter such that said peripheral edge of said separation device engages said surface of said container and interfits with the interior of the container in a dust-tight manner throughout movement of said pipe along said axis relative to said container with said fluidizing gas being permitted to escape from the container through said gas permeable surface of said separation device and as a result of a suitable pressure drop across said gas permeable surface, the filling height and the degree of compaction of the pulverulent material in the container being determined by the specific position of said open end of said pipe.

2. A method according to claim 1 comprising taking the pulverulent material for the filling from a storage container with the help of said fluidizing gas.

3. A method according to claim 2 wherein the fluidizing gas is air.

4. The method as claimed in claim 1 comprising, prior to filling the pulverulent material into the container, directing the pipe with said separation device to a position close to the bottom of said container and subsequently moving the pipe with the separation device toward the top of the container to carry out a filling motion.

5. The method as claimed in claim 4 comprising, prior to filling the pulverulent material into the container, directing the pipe with said separation device to a position close to the bottom of said container and subsequently moving the pipe with the separation device toward the top of the container to carry out a filling motion.

6. A method of filling and compacting pulverulent pyrogenically produced silicon dioxide material that is suspended in a fluidizing gas into a container comprising:

(a) introducing the material and the fluidizing gas into the container at a superatmospheric pressure through a pipe;

(b) separating a proportion of the fluidizing gas from the material by means of a separation device that is mounted flush to an end of said pipe and includes a surface that is permeable to said fluidizing gas; and (c) maintaining a dust tight seal simultaneously with step (b) between a peripheral edge of the separation device and the container, said edge being fixed to said separation device and moving with said pipe, whereby the pulverulent pyrogenically produced silicon dioxide material is kept within the container during the separation step.

7. A method according to claim 6, wherein the fluidizing gas is air.

* * * * *